US005617998A

United States Patent [19]

Buckley et al.

[11] Patent Number: 5,617,998

[45] Date of Patent: Apr. 8, 1997

[54] FUEL INJECTION NOZZLES

[75] Inventors: Paul Buckley; Gordon M. Reid, both of Kent, England

[73] Assignee: Lucas Industries, Public Limited Company, England

[21] Appl. No.: 399,298

[22] Filed: Mar. 3, 1995

[30] Foreign Application Priority Data

Mar. 5, 1994 [GB] United Kingdom ..... 9404260

[51] Int. Cl.[6] ..... F02M 45/10

[52] U.S. Cl. ..... 239/95

[58] Field of Search ..... 234/93, 95, 88, 234/124

[56] References Cited

U.S. PATENT DOCUMENTS 4,211,202 7/1980 Hafner ..... 239/88 X
4,489,886 12/1984 Kato ..... 239/124
4,979,676 12/1990 Hehn ..... 239/95

FOREIGN PATENT DOCUMENTS 0453145 10/1991 European Pat. Off. .
1541643 10/1967 France .
545559 6/1942 United Kingdom ..... 239/95
554446 7/1943 United Kingdom .

*Primary Examiner*—Kevin Weldon
*Attorney, Agent, or Firm*—Andrus, Sceales, Starke & Sawall

[57] ABSTRACT

A fuel injection nozzle includes a fuel pressure actuated valve member of the inwardly opening type which is movable by the action of fuel under pressure away from a seating to allow fuel flow from a nozzle inlet through an outlet. Mounted on the nozzle body is a spill valve which when operated allows fuel to escape from the nozzle inlet so as to lower the fuel pressure applied to the nozzle valve member. The spill valve is actuated by hydraulic means.

4 Claims, 1 Drawing Sheet

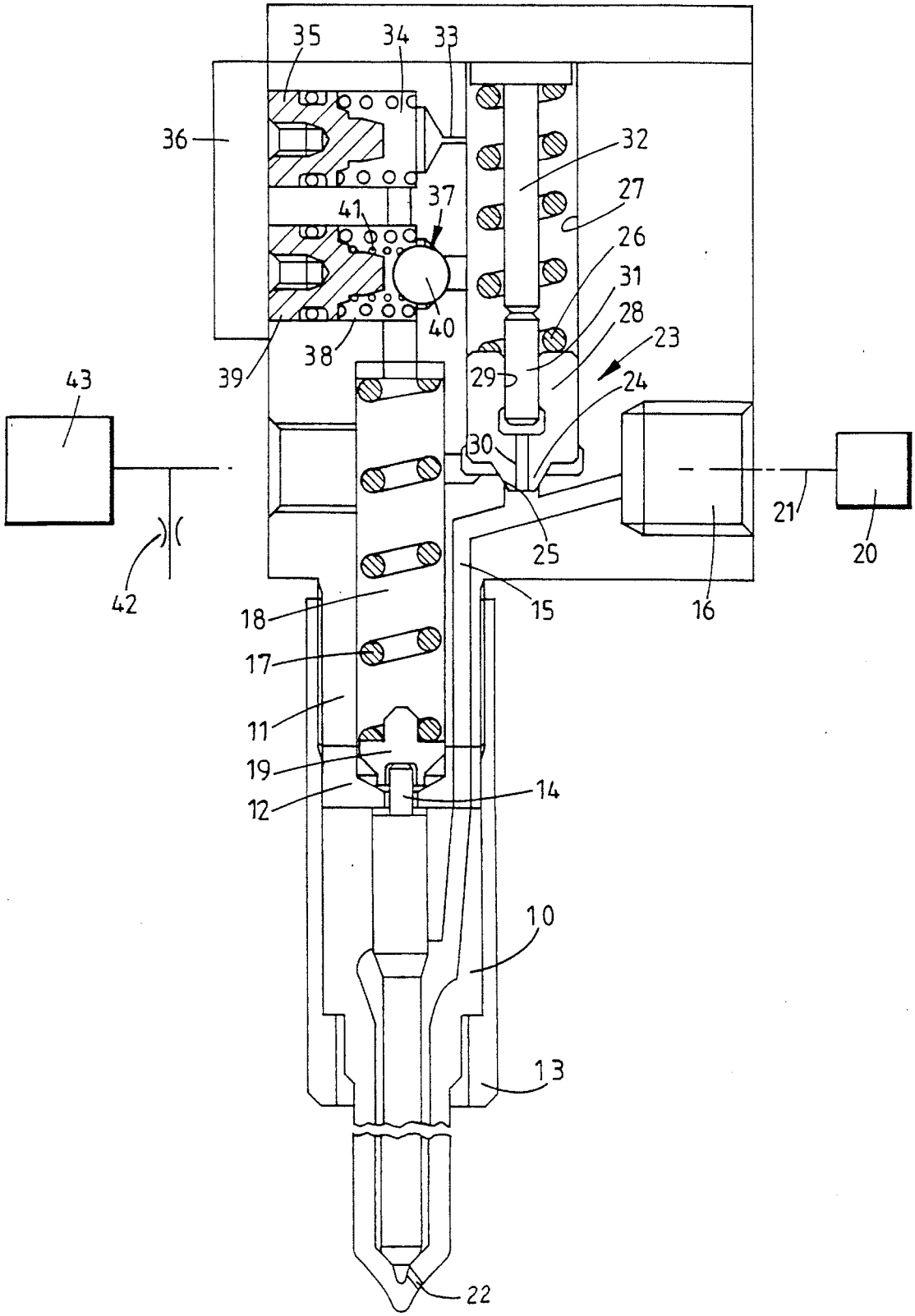
35
34
33
36
32
27
37
41
26
31
28
23
40
38
39
29
24
43
30
21
20
25
42
15
16
18
17
11
19
14
12
10
13
22

FUEL INJECTION NOZZLES

BACKGROUND OF THE INVENTION

This invention relates to fuel injection nozzles for use in fuel systems for supplying fuel to internal combustion engines, the systems incorporating a high pressure fuel supply means which is connected to a nozzle inlet by means of a high pressure pipeline, the fuel supply means being arranged to supply fuel to the nozzle inlet in timed relationship with an associated engine, the fuel injection nozzle being of the so called inwardly opening type employing a spring loaded fuel pressure actuated valve member which is movable by fuel pressure away from a seating to allow fuel to flow from the nozzle inlet through an outlet.

Such systems and fuel injection nozzles are well known in the art. In an example the high pressure fuel supply means is a cam actuated plunger pump in which fuel delivery takes place when the plunger is under the control of the leading flank of the cam at a time depending upon the amount of fuel previously supplied to the pumping chamber of the pump. The flow of fuel to the injection nozzle ceases when the plunger inward movement ceases as an associated cam follower moves over the crest of the cam lobe. The initial outward movement of the plunger which then takes place, causes a reduction in pressure in the pipeline and this facilitates closure of the valve member of the fuel injection nozzle. The rate of pressure reduction at the nozzle is relatively slow.

Systems employing a cam actuated pumping plunger are known in which the supply of fuel to the fuel injection nozzle is halted by opening a spill valve before the inward movement of the plunger is complete. The spill valve may be an electromagnetically operated valve and such an arrangement can provide for more rapid closure of the valve member of the fuel injection nozzle, a factor which is important from the point of view of minimising engine exhaust emissions. The exhaust emission regulations are becoming progressively tighter and as a result there is a tendency for the fuel injection pressures to be increased coupled with a demand for more rapid closure of the valve member of the fuel injection nozzle. The rate of the reduction of pressure at the inlet of the fuel injection nozzle is very much dependent upon the inertia of the fuel and the characteristics of the pipeline which connect the fuel supply means to the nozzle and also if such are provided, outlet valves in the outlet of the fuel pump.

SUMMARY OF THE INVENTION

The object of the present invention is to provide a fuel injection nozzle for the purpose specified in a simple and convenient form.

According to the invention a fuel injection nozzle for the purpose specified comprises a spill valve mounted in or adjacent to the fuel injection nozzle body, said spill valve when open permitting fuel to escape from said nozzle inlet so as to lower the fuel pressure applied to the valve member thereby to allow the valve member to close onto the seating and hydraulic means operable to open said spill valve.

BRIEF DESCRIPTION OF THE DRAWING

An example of a fuel injection nozzle in accordance with the invention will now be described with reference to the accompanying drawing.

DETAILED DESCRIPTION OF THE PREFERRED EMBODIMENT

Referring to the drawing the fuel injection nozzle includes a nozzle body 10 which is secured to a nozzle holder 11 through the intermediary of a distance piece 12, by means of a conventional cap nut 13. The nozzle body contains a conventional inwardly opening valve member which is housed within a bore and the end portion 14 of the valve member projects from the nozzle body in known manner. The nozzle body defines a fuel inlet (not shown) which is connected by means of a passage 15 with a fuel inlet 16 formed in the nozzle holder. The valve member is biased into engagement with a seating by means of a coiled compression spring 17 which is housed in a spring chamber 18 formed in the nozzle holder, the spring engaging at one end a spring abutment 19 which is mounted on the extension of the valve member.

The inlet 16 is connected to a high pressure fuel pump 20 by means of a high pressure pipeline 21. The pump 20 is a cam actuated plunger pump which incorporates a high pressure pumping chamber to which fuel can be supplied between delivery periods, by means of a low pressure pump.

The fuel injection nozzle and system so far described operates in a well known manner namely that when fuel under pressure is delivered by the pump 20, the fuel pressure acts upon the valve member to lift it away from a seating against the action of the spring 17. Once the valve member is lifted from the seating fuel can flow through one or more outlet orifices 22 formed in a nozzle tip. When the fuel pressure at the inlet is reduced, the valve member will move into engagement with the seating under the action of the spring and the flow of fuel to the associated engine will cease.

Mounted in the nozzle holder is a spill valve 23 and this comprises a valve member 24 which is biased into engagement with a seating 25 by means of a spring 26. The seating 25 is located in a branch passage extending from the passage 15 and terminating in the spring chamber 18. The seating 25 leads into a cylinder 27 in which there is slidable a piston 28 integrally formed with the valve member 24 and the aforesaid flow path includes the end of the cylinder 27 which surrounds the seating. As will be noted the diameter of the piston 28 is appreciably larger than the seat diameter of the valve member 24.

Formed in the piston is a blind bore 29 which opens onto the end of the piston remote from the valve member 24. The diameter of the bore 29 is slightly larger than the effective seat diameter and the inner end of the bore communicates with the passage 15 by way of a drilling 30 which extends through the valve member. The bore 29 is occupied by a slidable plunger 31 which extends outwardly of the bore and which is engagable with a stop member 32 to limit the extent of movement of the plunger away from the seating 25. The inner end of the plunger is engagable with the end wall of the blind bore to limit the movement of the piston but the end of the plunger is shaped so as not to obturate the passage 30 when engaging the end wall of the bore.

The end of the cylinder 27 remote from the seating communicates with the spring chamber 18 by way of a restrictor 33 defined by a narrow passage which is formed at the inner end of a blind drilling 34 connected by a passage to the spring chamber 18. The open end of the drilling is closed by a plug 35 which is held in position by means of a retaining plate 36. The aforesaid end of the cylinder 27 can also communicate with the spring chamber 18 by way of a spring loaded non-return valve 37 conveniently in the form of a ball valve. This valve includes a ball 40 which is biased by a spring 41 into engagement with a seating formed at the blind end of a further blind drilling 38 which is also closed by a plug 39 held in position by means of the plate 36. Each of the plugs 35 and 39 is provided with a respective spring to bias it into engagement with the plate 36.

The spring chamber 18 is connected to a drain by way of a restrictor 42 and also to a pressure pulse producing device 43. The device 43 can have a number of forms which will be discussed later.

In operation, before delivery of fuel commences the valve member of the nozzle together with the valve member 24 and the ball 40 are in engagement with their respective seatings. When fuel is delivered by the pump 20, the pressure of fuel at the inlet 16 is transmitted to the blind end of the bore 29 so that the valve member 24 is held in engagement with the seating 25. As the pressure continues to rise it will attain a value at which the force exerted by the spring 17 is overcome and the valve member of the nozzle will move away from its seating to permit flow of fuel through the outlet orifice 22. In most fuel injection nozzles the area of the valve member which is exposed to the fuel pressure increases when the valve member moves away from its seating so that the valve member moves rapidly to its open position. This rapid movement will produce a pulse of pressure in the spring chamber 18 and the restrictors 33 and 42 together with the force exerted by the spring 26 must be such as to prevent movement of the piston 28.

When it is desired to terminate delivery of fuel the device 43 is actuated to produce a large pressure pulse in the spring chamber 18 and this pulse of pressure acting on the area of the piston lying outside the seat area of the valve member 24, is sufficient to lift the piston against the action of the spring 26 and when this movement takes place the high pressure fuel from the inlet 16 flows into the spring chamber 18. This has the effect of reducing the pressure of fuel in the passage 15 very quickly and as a result the valve member of the nozzle can move into engagement with its seating. This movement of the valve member is assisted by the fact that the fuel from the inlet flows into the spring chamber 18 to increase the pressure therein and this pressure acts on the valve member thereby assisting the movement of the valve member towards its seating. This assistance is essential in order to minimise the risk of gases from the combustion chamber being forced through the outlet orifice 22 when the fuel pressure in the passage 15 is suddenly lowered. The remaining quantity of fuel which is delivered by the pump 20 flows into the spring chamber 18 and by way of the restrictor 42, to drain. During the movement of the valve member 24 away from its seating fuel is displaced by the piston 28 from the cylinder 27 and this fuel flows into the spring chamber 18 by way of the non-return valve 37 and to a lesser extent through the restrictor 33. Following the initial movement of the piston 28, into engagement with the plunger, the non-return valve 37 closes and the restrictor 33 restricts the rate at which the piston and valve member return under the action of the spring 26. The restrictor 33 also acts to prevent to any substantial extent, the pressure pulse generated by the device 43 acting on the end of the piston 28 remote from the seating.

In a modification the plunger 31 is biased into engagement with the end wall of the bore 29 by means of a pre-loaded spring. At low delivery pressures the plunger remains in contact with the end wall but as the pressure increases the spring pre-load will be overcome and the plunger will move into engagement with the stop 32. This has the effect of absorbing part of the fuel delivered by the pump thereby reducing the rate of pressure rise and possibly reducing the pressure at the inlet of the nozzle. In addition, the increase of volume of fuel at high pressure will have an effect and these effects can be utilized to produce some modification to the rate of injection of fuel into the engine.

The pump 20 has been described as a cam operated plunger pump and for an engine installation may be a rotary distributor type of pumping apparatus in which a single pump delivers fuel to the injection nozzles of the engine in turn. In this case it is possible to provide for variation in the initial rate of fuel supply through the injection nozzle by making use of the varying rate of the initial portion of the leading flank of the actuating cam or cams. This is achieved by controlling the amount of fuel which is supplied to the bore containing the pumping plunger or plungers. If the bore is only partially filled the plunger movement will commence when the associated follower is engaging the main relatively steep portion of the leading flank and fuel will be delivered to the nozzle at a high rate. If however more fuel is supplied to the bore, the pumping plunger movement will commence when the cam follower engages the initial less steep portion of the leading flank and hence the initial delivery of fuel will be at a reduced rate.

The high pressure fuel supply means may be a so called common rail system in which fuel is stored in an accumulator at high pressure and is released to the injection nozzle by operating respective valves.

The device 43 can have several forms. In its simplest form it can comprise a plunger pump in which the plunger is actuated by an electromagnet or by a piezo-electric stack. In this case the plunger and its actuator could be mounted in or adjacent the nozzle holder.

The device 43 may however be located in the pump and comprise a valve operable to provide the required trigger pulse from the high pressure pump. In this case the trigger pulse would be conveyed to the nozzle by a pipeline connected to the spring chamber 18. This pipeline could also be used to convey the spilled fuel back to the pump so that the restrictor 42 would also be located in the pump. In this case due allowance would have to be made for the time taken for the pressure pulse to travel to the nozzle.

In another arrangement the device 43 may comprise an ON/OFF valve operable to connect the inlet 16 to the spring chamber 18. The ON/OFF valve may be operated directly by an actuator or it may comprise a servo valve controlled by an electromagnetically operable valve.

In the case where the high pressure fuel supply means is a common rail system as previously mentioned, the accumulator provides a source of fuel at a high pressure which could be utilised to generate the trigger pulse.

The device 43 may be common to a group of injection nozzles of an engine or all the injection nozzles providing there is no overlap in the fuel supply periods of the nozzles controlled by the device.

We claim:

1. A fuel injection nozzle for use in a fuel system for supplying fuel to an internal combustion engine, the system incorporating high pressure fuel supply means which is connected to a nozzle inlet by means of a high pressure pipeline, the fuel supply means being arranged to supply fuel to the nozzle inlet in timed relationship with the associated engine, the fuel injection nozzle being of the inwardly opening type employing a spring loaded fuel pressure actuated valve member which is movable by fuel pressure from a seating to allow fuel flow through an outlet, a spill valve mounted in close proximity to the fuel injection nozzle body, said spill valve when open allowing fuel to escape from the nozzle inlet so as to lower the fuel pressure applied to the valve member thereby to allow the valve member to close onto the seating, said spill valve including a piston slidable in a cylinder, a seating defined at one end of the cylinder, the seating communicating with the nozzle inlet, a valve member formed at one end of the piston, a spring urging the valve member into engagement with the seating, the piston and the cylinder when the valve member is in engagement with the seating, defining a space, and hydraulic means connected to said space and including means for generating a high pressure pulse which acts on the piston to lift the valve member from the seating to open said spill valve, thereby allowing fuel from the nozzle inlet to flow into said space.

2. A fuel injection nozzle according to claim 1, in which said space is connected to a spring chamber in which is mounted a spring for the valve member of the nozzle, an end of the valve member being exposed to the pressure in the spring chamber to assist closure of the valve member onto its seating, said hydraulic means further including a restrictor for restricting the rate at which fuel can flow from the spring chamber.

3. A fuel injection nozzle according to claim 2 in which the other end of the cylinder is in communication with said spring chamber by way of a restrictor and by way of a non-return valve which allows fuel flow from the cylinder into the spring chamber.

4. A fuel injection nozzle according to claim 1 including a bore formed in the piston, passage means through which the bore communicates with the nozzle inlet, and a plunger mounted in the bore, said bore having a diameter which is slightly larger than the effective seat diameter of the seating and a stop for limiting the movement of the plunger under the action of the fuel pressure at the nozzle inlet.

* * * * *